US006447621B1

(12) United States Patent
Tokoro et al.

(10) Patent No.: US 6,447,621 B1
(45) **Date of Patent: *Sep. 10, 2002**

(54) R-T-B RARE EARTH SINTERED MAGNET HAVING IMPROVED SQUARENESS RATIO AND METHOD FOR PRODUCING SAME

(75) Inventors: Hisato Tokoro; Nobuhiko Fujimori, both of Saitama-ken (JP)

(73) Assignee: Hitachi Metals, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/448,832

(22) Filed: Nov. 24, 1999

(30) Foreign Application Priority Data

Nov. 25, 1998 (JP) ..... 10-333545
Sep. 28, 1999 (JP) ..... 11-274343

(51) Int. Cl.[7] ..... H01F 1/057; H01F 3/08
(52) U.S. Cl. ..... 148/302; 75/246
(58) Field of Search ..... 75/246; 148/302

(56) References Cited

U.S. PATENT DOCUMENTS 6,004,407 A * 12/1999 Kojima et al. ..... 148/302
6,019,859 A * 2/2000 Kanekiyo et al. ..... 148/302
6,027,576 A * 2/2000 Schrey et al. ..... 148/100
6,045,629 A * 4/2000 Hasegawa et al. ..... 148/302

FOREIGN PATENT DOCUMENTS

EP 0 237 587 A1 9/1987
JP 63310905 A 10/1987
JP 03072011 A 11/1989

OTHER PUBLICATIONS

Patent Abstracts of Japan, vol. 013, No. 081 (E–719), Feb. 23, 1989 & JP 63 262803 A (Mitsubishi Metal Corp), Oct. 31, 1988 *abstract*.

Claude, E. et al., "Evidence of a Quantitative Relationship Between the Degree of Hydrogen Intercalation and the Coercivity of the Two Permanent Magnet Alloys ND2FE14B and ND2FE11C03B" IEEE Transactions on Magnetics, US, IEEE Inc. New York, vol. 29, No. 6, Nov. 1, 1993, pp. 2767–2769.

* cited by examiner

*Primary Examiner*—Daniel J. Jenkins
(74) *Attorney, Agent, or Firm*—Sughrue Mion, PLLC

(57) ABSTRACT

An R—T—B rare earth sintered magnet containing an $R_2T_{14}B$-type intermetallic compound as a main phase and thus having improved squareness ratio is produced by carrying out a reduction and diffusion method comprising the steps of (a) mixing oxide powder of at least one rare earth element R, T-containing powder, wherein T is Fe or Fe and Co, B-containing powder, and a reducing agent such as Ca, (b) heating the resultant mixture at 900–1350° C. in a non-oxidizing atmosphere, (c) removing reaction by-products from the resultant reaction product by washing, and (d) carrying out a heat treatment for Ca removal by heating the resultant R—T—B rare earth alloy powder at 900–1200° C. in vacuum at 1 Torr or less, followed by pulverization of the resultant alloy powder bulk, molding, sintering in vacuum, heat treatment, and surface treatment. The alloy powder bulk obtained by the heat treatment for Ca removal is preferably pulverized after removal of its surface layer.

17 Claims, 9 Drawing Sheets

[ 2 $\bar{4}$ 0 ] Direction of Incident Electron Beam

[ 13 $\bar{9}$ $\bar{12}$ ] Direction of Incident Electron Beam

[ 13 $\bar{9}$ $\bar{12}$ ] Direction of Incident Electron Beam

R-T-B RARE EARTH SINTERED MAGNET HAVING IMPROVED SQUARENESS RATIO AND METHOD FOR PRODUCING SAME

FIELD OF THE INVENTION

The present invention relates to a high-performance sintered magnet formed from R—T—B alloy powder produced by a reduction and diffusion method, and a method for producing such a sintered magnet.

DESCRIPTION OF PRIOR ART

Among rare earth permanent magnets, R—T—B rare earth sintered magnets, wherein R is at least one rare earth element including Y, at least one of Nd, Dy and Pr being indispensable, and T is Fe or Fe and Co, are highly useful, high-performance magnets, much better in cost performance than Sm—Co permanent magnets containing expensive Co and Sm. Accordingly, they are widely used in various magnet applications.

The R—T—B rare earth alloy powder can be obtained by pulverizing alloys produced through melting, such as strip-cast alloys, alloys produced by high-frequency melting and casting, etc. Also, for instance a reduction and diffusion method (hereinafter referred to as "R/D method") provides less expensive R—T—B alloy powder (hereinafter referred to as "R/D powder"). This R—T—B alloy powder is produced by mixing rare earth element oxide powders, Fe—Co—B alloy powder, Fe powder and a reducing agent (Ca) in proper formulations, heating the resultant mixture in an inert gas atmosphere to reduce the rare earth element oxides and diffuse the resultant rare earth metal into a metal phase of Fe, Co and B, thereby forming an R—T—B alloy powder containing an $R_2T_{14}B$-type intermetallic compound as a main phase, removing reaction by-products such as CaO, etc. by washing, and then drying.

The R/D powder is less expensive than powder of alloys produced through melting, and thus more advantageous in reduction of the production cost of R—T—B rare earth sintered magnets. However, the conventional R/D powder contains more inevitable impurities such as Ca, O, etc. than powder of alloys produced through melting. Therefore, R—T—B rare earth sintered magnets formed from the R/D powder are poorer in squareness ratio of the demagnetization curve and more difficult in providing high-performance magnets than those formed from powders of alloys produced through melting. The poor squareness ratio means that desired magnetic flux cannot be obtained in permeance coefficients of magnetic circuits widely used in practical applications, leading to deterioration in thermal demagnetization. The squareness ratio is a value defined by Hk/iHc, wherein Hk is a value of H at a position at which $4\pi I$ is 0.9 Br (Br is a residual magnetic flux density) in the second quadrant of a graph of a $4\pi I$-H curve, wherein $4\pi I$ represents the intensity of magnetization, and H represents the intensity of a magnetic field.

Japanese Patent Laid-Open No. 63-310905 discloses that products obtained by a reduction and diffusion reaction are washed with water containing $10^{-3}10^{-2}$ g/L of an inhibitor (corrosion-suppressing agent), dewatered and then dried in vacuum to provide low-oxygen, low-Ca, Nd—Fe—B permanent magnet alloy powder. However, when sintered magnets are obtained by subjecting the Nd—Fe—B permanent magnet alloy powder (Ca content: 0.05–0.06 weight %) produced according to EXAMPLES of Japanese Patent Laid-Open No. 63-310905 to jet-milling, molding in a magnetic field, sintering in an Ar gas and a heat treatment, they contain more than 0.01 weight % of Ca, thereby being poor in squareness ratio and thermal stability.

Japanese Patent 2,766,681 discloses a method for producing rare earth-iron-boron alloy powder for sintered magnets comprising the steps of mixing rare earth oxide powders, iron-containing powder, B-containing powder and Ca, heating the resultant mixture at 900–1200° C. in a non-oxidizing atmosphere, wet-treating the reaction product, heating it at 600–1100° C., and finely pulverizing the resultant alloy powder to an average particle size of 1–10 $\mu$m. In EXAMPLES of Japanese Patent 2,766,681, the R/D reaction product is washed with water, dried in vacuum, heat-treated in vacuum under the conditions shown in Table 1 below, cooled, finely pulverized, and then molded without a magnetic field, to provide a green body having improved bending strength. However, Japanese Patent 2,766,681 neither teaches the correlation between the heat treatment in vacuum in Table 1 and the amount of Ca remaining in the R/D powder at all, nor discloses that a combination of Ca removal by the heat treatment in vacuum of the R/D powder and Ca removal by the sintering in vacuum of the green body drastically reduces a Ca content in the R—T—B rare earth sintered magnets, thereby remarkably improving the squareness ratio of the sintered magnets.

Accordingly, an object of the present invention is to provide an R—T—B rare earth sintered magnet formed from R—T—B rare earth alloy powder produced by a reduction and diffusion method, and a method for producing such an R—T—B rare earth sintered magnet.

SUMMARY OF THE INVENTION

The method for producing an R—T—B rare earth sintered magnet containing an $R_2T_{14}B$-type intermetallic compound as a main phase and thus having improved squareness ratio according to the present invention comprises carrying out a reduction and diffusion method comprising the steps of (a) mixing oxide powder of at least one rare earth element R, wherein R is at least one rare earth element including Y, at least one of Nd, Dy and Pr being indispensable, T-containing powder, wherein T is Fe or Fe and Co, B-containing powder, and at least one reducing agent selected from the group consisting of Ca, Mg and hydrides thereof, (b) heating the resultant mixture at 900–1350° C. in a non-oxidizing atmosphere, (c) removing reaction by-products from the resultant reaction product by washing, and (d) carrying out a heat treatment for Ca removal by heating the resultant R—T—B rare earth alloy powder at 900–1200° C. in vacuum at 1 Torr or less, followed by pulverization of the resultant alloy powder bulk, molding, sintering in vacuum, heat treatment, and surface treatment. The alloy powder bulk obtained by the heat treatment for Ca removal is preferably pulverized after removal of its surface layer.

The R—T—B rare earth sintered magnet having improved squareness ratio according to the present invention contains as a main phase an $R_2T_{14}B$-type intermetallic compound, wherein R is at least one rare earth element including Y, at least one of Nd, Dy and Pr being indispensable, and T is Fe or Fe and Co, the amount of Ca contained as an inevitable impurity being 0.01 weight % or less, and c-axis directions of core portions of the main-phase crystal grain particles being deviated by 5° or more from those of surface layer portions of the main-phase crystal grain particles. In the metal structure of the R—T—B rare earth sintered magnet, the number of the main-phase crystal grain particles having surface layer portions is preferably 50% or less of the total number of the main-phase crystal grain particles.

The composition of the R—T—B rare earth sintered magnet preferably comprises as main components 27–34 weight % of R, and 0.5–2 weight % of B, the balance being substantially T, and the amounts of oxygen and carbon contained as inevitable impurities being 0.6 weight % or less and 0.1 weight % or less, respectively. The R—T—B rare earth sintered magnet preferably has a squareness ratio of 95.0% or more at room temperature.

BRIEF DESCRIPTION OF THE DRAWINGS

FIG. 3(*b*) is a transmission electron microscopic photograph of FIG. 3(*a*) to which reference numerals are added;

FIG. 7(*b*) is a schematic view showing diffraction mottle corresponding to the electron diffraction image of FIG. 7(*a*), to which indices are added;

FIG. 8(*b*) is a schematic view showing diffraction mottle corresponding to the electron diffraction image of FIG. 8(*a*), to which indices are added;

FIG. 9(*b*) is a schematic view showing diffraction mottle corresponding to the electron diffraction image of FIG. 9(*a*), to which indices are added.

DETAILED DESCRIPTION OF THE PREFERRED EMBODIMENTS

[1] R—T—B Rear Earth Sintered Magnet

Figure 1:
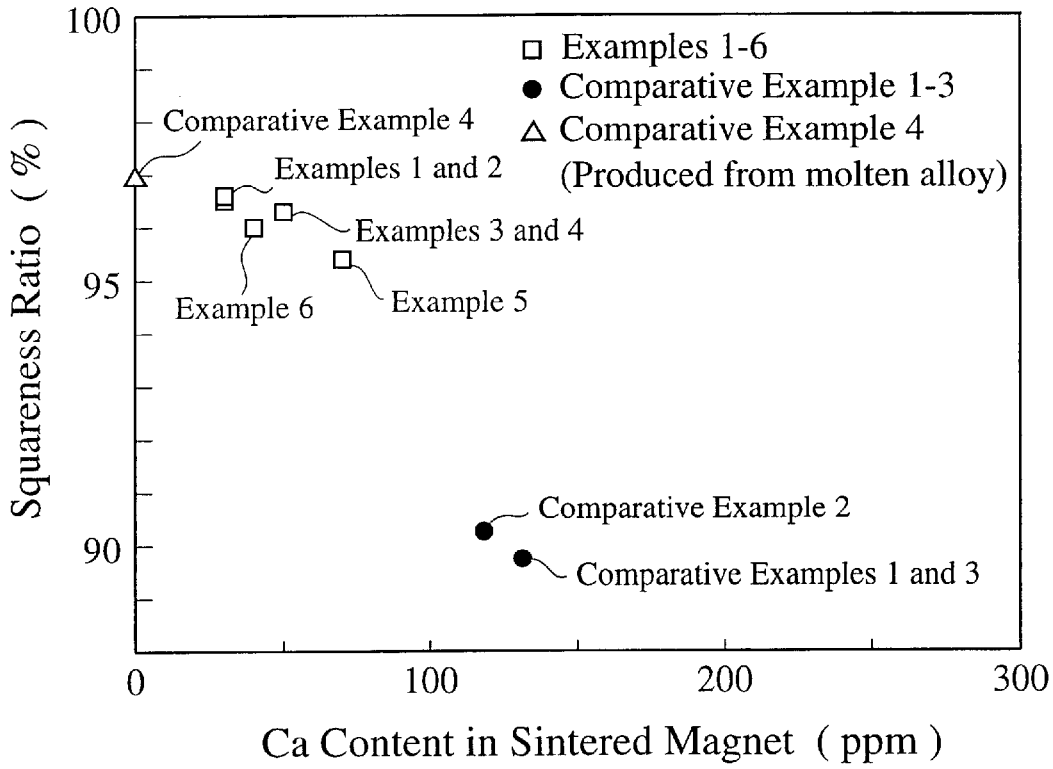
FIG. 1 is a graph showing the correlation between the Ca content and a squareness ratio in the R—T—B rare earth sintered magnet formed from the R/D alloy powder produced by a Ca-reduction and diffusion method.

The R—T—B rare earth sintered magnet of the present invention preferably comprises as main components 27–34 weight % of R, and 0.5–2 weight % of B, the balance being substantially T, and the amounts of oxygen and carbon contained as inevitable impurities being 0.6 weight % or less and 0.1 weight % or less, respectively. To improve magnetic properties, the R—T—B rare earth sintered magnet preferably contains at least one of Nb, Al, Ga and Cu.

(a) Composition of main components (1) R Element

The R element is at least one rare earth element including Y, and at least of Nd, Dy and Pr is indispensable. The R element is preferably not only Nd, Dy or Pr alone, but also a combination of Nd+Dy, Dy+Pr, or Nd+Dy+Pr, etc. The R content is preferably 27–34 weight %. When the R content is less than 27 weight %, as high iHc as suitable for actual use cannot be obtained. On the other hand, when it exceeds 34 weight %, Br decreases drastically.

(2) B

The content of B is 0.5–2 weight %. When the content of B is less than 0.5 weight %, as high iHc as suitable for actual use cannot be obtained. On the other hand, when it exceeds 2 weight %, Br decreases drastically. The more preferred content of B is 0.9–1.5 weight %.

(3) T element

The T element is Fe alone or Fe+Co. The addition of Co serves to provide the sintered magnet with an improved corrosion resistance, and elevate its Curie temperature, thereby improving a heat resistance as a permanent magnet. However, when the content of Co exceeds 5 weight %, an Fe—Co phase harmful to the magnetic properties of the R—T—B rear earth sintered magnet is formed, resulting in decrease in Br and iHc. Accordingly, the content of Co is preferably 5 weight % or less. On the other hand, when the content of Co is less than 0.3 weight %, the effects of improving corrosion resistance and heat resistance are insufficient. Thus, when Co is added, the content of Co is preferably 0.3–5 weight %.

(4) Other elements

The content of Nb is 0.1–2 weight %. The inclusion of Nb serves to form borides of Nb in a sintering process, thereby suppressing the excessive growth of crystal grains. When the content of Nb is less than 0.1 weight %, sufficient effects of adding Nb cannot be obtained. On the other hand, when the content of Nb is more than 2 weight %, too much borides of Nb are formed, resulting in decrease in Br.

The amount of Al is preferably 0.02–2 weight %. When the amount of Al is less than 0.02 weight %, sufficient effects of adding Al cannot be obtained. On the other hand, when the content of Al is more than 2 weight %, the Br of the R—T—B rare earth sintered magnet drastically decreased.

The amount of Ga is preferably 0.01–0.5 weight %. When the amount of Ga is less than 0.01 weight %, significant effects of improving iHc cannot be obtained. On the other hand, when it exceeds 0.5 weight %, the Br of the R—T—B rare earth sintered magnet drastically decreased.

The amount of Cu is preferably 0.01–1 weight %. The addition of a trace amount of Cu serves to improve iHc of the sintered magnet. However, when the content of Cu exceeds 1 weight %, effects of adding Cu are saturated. On the other band, when the content of Cu is less than 0.01 weight %, sufficiently effects cannot be obtained.

(b) Inevitable impurities

The R—T—B rare earth sintered magnet of the present invention contains oxygen, carbon and Ca as inevitable impurities in addition to the main components. The content of oxygen is preferably 0.6 weight % or less, and the content of carbon is preferably 0.1 weight % or less. Also, the content of Ca contained as an inevitable impurity is preferably 0.01 weight % or less.

(c) Metal structure

The R—T—B rear earth sintered magnet of the present invention comprises as a main phase an $R_2T_{14}B$-type intermetallic compound, which includes one having a surface layer portion and another having no surface layer portion. In the main-phase crystal grain particles having a surface layer portion, the c-axis direction of a surface layer portion is deviated by 5° or more from that of a core portion. A ratio of the number $n_1$ of the main-phase crystal grain particles having surface layer portions to the total number $(n_1+n_2)$ of the main-phase crystal grain particles, $[n_1/(n_1+n_2)]\times100\%$, is preferably 50% or less, wherein $n_1$ is the number of main-phase crystal grain particles having surface layer portions, and $n_2$ is the number of main-phase crystal grain particles having no surface layer portions in a certain field of a cross section photograph of the metal structure. When the ratio of the number $n_1$ of the main-phase crystal grain particles is 50% or less, the R—T—B rare earth sintered magnet has a high squareness ratio. To increase the squareness ratio further, the ratio of the number $n_1$ of the main-phase crystal grain particles having surface layer portions to the total number $(n_1+n_2)$ of the main-phase crystal grain particles is preferably 30% or less.

[2] Production method of R—T—B rare earth sintered magnet (a) Starting Materials The rare earth oxides used for the production of the R/D powder are preferably $Nd_2O_3$, $Dy_2O_3$ and $Pr_6O_{11}$, and one or more of these rare earth oxides are used in combination.

Usable as the T-containing powder is Fe powder or Fe—Co powder. The T-containing powder may be alloy powder further containing at least one of Nb, Al, Ga and Cu as other elements. Such alloy powder may be Fe—Nb alloy powder, Fe—Ga alloy powder, etc. Also, the B-containing powder may be Fe—B alloy powder, Fe—Co—B alloy powder, etc.

The reducing agent may be at least one selected from the group consisting of Ca, Mg and hydrides thereof. Ca and Mg are preferably used in the form of metal powder.

(b) Heat Treatment for Reduction and Diffusion

When the reduction and diffusion temperature is lower than 900° C., a commercially efficient reduction and diffusion reaction cannot be used. On the other hand, when it exceeds 1350° C., facilities such as reaction furnaces are remarkably deteriorated. Thus, the reduction and diffusion temperature is 900–1350° C. The preferred reduction and diffusion temperature is 1000–1200° C.

The amount of a reducing agent (Ca) is preferably 0.5–2 times a stoichiometric amount for reduction. The stoichiometric amount for reduction means the amount of the reducing agent that can carry out 100-% reduction of metal oxides in a chemical reaction in which metal oxides are reduced to metals with the reducing agent. When the amount of a reducing agent is less than 0.5 times the stoichiometric amount for reduction, a commercially efficient reduction reaction does not take place. On the other hand, when it exceeds 2 times, there remains too much reducing agent, resulting in deterioration in magnetic properties of the R—T—B rare earth sintered magnet.

(c) Washing

The powder subjected to the reduction and diffusion treatment is preferably washed with water, etc. so that Ca remaining in the R/D powder is dissolved out as much as possible.

(d) Heat Treatment for Removal of Ca

It is presumed that Ca removed by the Ca removal heat treatment is metallic Ca that does not contribute to the reduction of rare earth oxides. Therefore, a temperature for the heat treatment for Ca removal is preferably between a melting point of Ca and 900° C. Also, to avoid the molten R/D powder from reacting with a reactor, the Ca removal heat treatment temperature is more preferably 900–1200° C. and most preferably 900–1100° C.

To remove Ca from the R/D powder, it is necessary to evaporate Ca at a degree of vacuum lower than the vapor pressure of Ca. Specifically, the degree of vacuum is preferably 1 Torr or less, more preferably between 1 Torr and $9\times10^{-6}$ Torr. When the degree of vacuum is more than 1 Torr, it is difficult to remove Ca. On the other hand, a high degree of vacuum of less than $9\times10^{-6}$ Torr needs a high-evacuation apparatus, resulting in increase in cost.

The heat treatment time for Ca removal is preferably 0.5–30 hours, more preferably 1–10 hours. When the heat treatment time is less than 0.5 hours, Ca removal is insufficient. On the other hand, when the heat treatment time is more than 30 hours, effects of removing Ca are saturated, resulting in remarkable oxidation.

(e) Surface Working

The R/D powder subjected to the heat treatment for Ca removal is agglomerated to a bulk having an oxide surface layer, in which carbon is concentrated. Thus, it is preferable to remove the oxide surface layer from the R/D powder bulk mechanically by a grinder, etc. in an inert gas atmosphere such as an Ar gas, to reduce the amounts of oxygen and carbon. Instead of mechanical working for removing the surface layer, such means as washing with acid is possible, though washing with acid likely removes the R element predominantly, resulting in drastic oxidation.

(f) Pulverization

The R/D powder bulk is crushed and pulverized to a particle size suitable for molding. The pulverization may preferably be carried out by a dry pulverization method such as jet milling using an inert gas as a medium or a wet pulverization method such as ball milling, etc. to obtain high magnetic properties, it is preferable that the R/D powder is finely pulverized by a jet mill in an inert gas atmosphere containing substantially no oxygen, and that the resultant fine powder is directly recovered from the inert gas atmosphere into a mineral oil, a synthetic oil, a vegetable oil, etc. without bringing the fine powder into contact with the air, thereby providing a mixture (slurry). By preventing the fine powder from being in contact with the air, it is possible to suppress oxidation and the adsorption of moisture.

(g) Molding

The fine R/D powder is dry- or wet-molded in a magnetic field by a molding die. To suppress the deterioration of magnetic properties by oxidation, the fine R/D powder is preferably kept in an oil or in an inert gas atmosphere immediately after molding and until entering into a sintering furnace. In the case of the dry-molding, the R/D powder is preferably pressed in a magnetic field in an inert gas atmosphere;

(h) Sintering in Vacuum

The sintering conditions of the green body should be determined such that a high-density sintered body can be obtained while efficiently removing Ca during the processes of molding to sintering. Specifically, a degree of vacuum and a temperature elevation speed are important in the process of temperature elevation from room temperature to the sintering temperature.

The sintering conditions are preferably 1030–1150° C.×0.5–8 hours. When the sintering conditions are less than 1030° C.×0.5 hours, the sintered magnet does not have a sufficient density for actual applications. On the other hand, when they exceed 1150° C.×8 hours, too much sintering takes place, resulting in excessive growth of crystal grains, which leads to deterioration in squareness ratio and coercivity of the resultant R—T—B rare earth sintered magnet.

The degree of vacuum in the process of temperature elevation for sintering is preferably $1\times10^{-2}$ Torr or less, and particularly $9\times10^{-6}$ Torr or more for practical purposes, taking into consideration apparatus cost. The temperature elevation speed for sintering is preferably 0.1–500° C./minute, more preferably 0.5–200° C./minute particularly 1–100° C./minute. When the temperature elevation speed is less than 0.1° C./minute, commercially efficient production of sintered magnets is difficult. On the other hand, when it exceeds 500° C./minute, there is too long overshoot time until reaching the desired sintering temperature, resulting in deterioration in magnetic properties. Incidentally, instead of continuous temperature elevation the green body may be kept at a certain temperature in a range of 550° C. to 1050° C. for 0.5–10 hours in the process of temperature elevation, to accelerate the removal of Ca thereby improving the squareness ratio of the R—T—B rare earth sintered magnet.

The R—T—B rare earth sintered magnet obtained by sintering in vacuum under the above conditions has a density of 7.50 g/cm$^3$ or more. Also, in the case of molding a slurry of the R/D powder dispersed in an oxidation-resistant oil, removing the oil from the resultant green body, sintering the green body, and heat-treating and surface-treating the resultant sintered body, it is possible to provide the sintered body with a density of 7.53–7.60 g/cm$^3$.

(i) Heat Treatment

The resultant R—T—B sintered body is heat-treated at a temperature of 800–1000° C. for 0.2–5 hours in an inert gas atmosphere such as an argon gas, etc. This is called a first heat treatment. When the heating temperature is lower than 800° C. or higher than 1000° C., sufficient coercivity cannot be achieved. After the first heat treatment, the sintered body is preferably cooled to a temperature between room temperature and 600° C. at a cooling speed of 0.3–50 C/minute. When the cooling speed exceeds 50° C./minute, an equilibrium phase necessary for aging cannot be obtained, thereby failing to achieve sufficiently high coercivity. On the other hand, the cooling speed of less than 0.3° C./minute needs too long a heat treatment time, economically disadvantageous in commercial production. The more preferred cooling speed is 0.6–2.0° C./minute. The cooling is preferably stopped at room temperature, though it may be until 600° C. with slight sacrifice of iHc, from which the sintered body may be rapidly cooled. The sintered body is more preferably cooled to a temperature between room temperature and 400° C.

The heat treatment is preferably further carried out at a temperature of 500–650° C. for 0.2–3 hours. This is called a second heat treatment. Though varying depending on the composition, the second heat treatment at 540–640° C. is effective. When the heat treatment temperature is lower than 500° C. or higher than 650° C., the sintered magnet may suffer from irreversible loss of flux even though high coercivity is achieved. After the heat treatment, the sintered body is preferably cooled at a cooling speed of 0.3–400° C./minute as in the case of the first heat treatment. Cooling can be carried out in water, a silicone oil or in an argon gas atmosphere. When the cooling speed exceeds 400° C./minute, samples are cracked by rapid quenching, failing to provide commercially valuable permanent magnet materials. On the other hand, when the cooling speed is less than 0.3° C./minute, phases undesirable for coercivity iHc are formed in the process of cooling.

(j) Surface Treatment

To prevent oxidation of the R—T—B rare earth sintered magnet, it should be subjected to a surface treatment, by which the R—T—B rare earth sintered magnet is coated with a dense surface layer having a good heat resistance. Such a surface treatment may be Ni plating, epoxy resin deposition, etc.

The present invention will be described in detail referring to EXAMPLES below without intention of limiting the present invention thereto.

EXAMPLE 1

To obtain a main component composition comprising 26.0 weight % of Nd, 6.5 weight % of Pr, 1.05 weight % of B, 0.10 weight % of Al, 0.14 weight % of Ga, the balance being substantially Fe, $Nd_2O_3$ powder, $Pr_6O_{11}$ powder, ferroboron powder, Ga—Fe powder and Fe powder each having a purity of 99.9% or more were formulated together with a reducing agent (metallic Ca particles) in an amount of 1.2 times by weight the stoichiometric amount thereof, and mixed in a mixer. The resultant mixed powder was charged into a stainless steel vessel, in which a Ca-reduction and diffusion reaction was carried out at 1100° C. for 4 hours in an Ar gas atmosphere. After cooled to room temperature, the resultant reaction product was washed with water containing 0.01 g/L of a rust-preventing agent and dried in vacuum to obtain R/D powder. This R/D powder contained 0.05 weight % of Ca.

A stainless steel vessel into which the R/D powder was charged was placed in a vacuum furnace to carry out a heat treatment for Ca-reduction and diffusion at 1100° C. for 6 hours in vacuum at about $1\times10^{-4}$ Torr, followed by cooling to room temperature. The Ca-removed R/D powder was in the form of a partially sintered bulk. The observation of a cross section of this bulk revealed that a black surface layer was formed on the bulk to a depth of 1–3 mm from the surface. The black color of the surface layer was due to oxidation and concentrated carbon, which was derived from the melting loss of stainless steel vessel during the Ca-removal heat treatment.

The black surface layer was removed from the R/D powder bulk by a grinder in an Ar gas atmosphere to analyze the contents of Ca, O, N, H and C in the black surface layer. As shown in Table 1, the black surface layer contained large amounts of O and C. Also, the analysis of the contents of Ca, O, N, H and C in the bulk after removal of the black surface layer revealed, as shown in Table 1, that an inner portion of the bulk had an content about half of that of the black surface layer, though its Ca content was slightly larger than that of the black surface layer. In addition, an inner portion of the bulk had an extremely small C content. Accordingly, the bulk from which the black surface layer was removed in an Ar gas atmosphere was used as a starting alloy for the R—T—B rare earth sintered magnet.

The starting alloy was coarsely pulverized, and the resultant coarse powder was charged into a jet mill in which an oxygen concentration was 0.01 volume % by nitrogen gas purge, for fine pulverization to an average particle size of 4.1 $\mu$m. The resultant fine powder was compression-molded at a pressure of 1.6 ton/cm$^2$ while applying a transverse magnetic field of 8 kOe. The resultant green body was sintered in vacuum of about $1\times10^{-4}$ Torr by heating at an average temperature elevation speed of 1° C./minute to 1080° C. which was kept for 3.5 hours. The resultant sintered body was subjected to a two-step heat treatment comprising a first heat treatment at 900° C. for 1 hour and a second heat treatment at 550° C. for 1 hour in an Ar gas atmosphere. After machining to a predetermined shape, the sintered body was deposited with an epoxy resin at an average thickness of 10 $\mu$m to provide the sintered magnet of the present invention.

The analysis of the resultant sintered magnet revealed that its main component was composed of 26.2 weight % of Nd, 6.6 weight % of Pr, 1.07 weight % of B, 0.08 weight % of Al, and 0.14 weight % of Ga, the balance being Fe, and that the amounts of inevitable impurities per the total amount of the sintered magnet were 30 ppm for Ca, 5620 ppm for O, and 0.07 weight % for C.

A 4πI-H demagnetization curve of this sintered magnet was obtained at room temperature (25° C.) to determine a squareness ratio (Hk/iHc), coercivity iHc and thermal demagnetization ratio. The thermal demagnetization ratio was determined by measuring the magnetic flux $\Phi_1$ of a magnetized sample at 25° C. The sample was obtained by working the sintered magnet to a shape with a permeance coefficient pc=1.0, and then magnetizing under the conditions of saturating magnetic properties. Next, the magnetized sample was placed in a thermostatic chamber whose atmosphere was air, to measure the magnetic flux $\Phi_2$ of the sample after heated at 80° C. for 1 hour and then cooled to 25° C. The thermal demagnetization ratio was calculated from $\Phi_1$ and $\Phi_2$ by the following equation:

$$\text{Thermal demagnetization ratio}=[(\Phi_1-\Phi_2)\div\Phi_1]\times 100\%.$$

The results are shown in Table 2.

TABLE 1

| Impurities in R/D Powder | Ca (ppm) | O (ppm) | N (ppm) | H (ppm) | C (wt %) |
|---|---|---|---|---|---|
| Black Surface Layer | 50 | 8420 | 190 | 1150 | 0.200 |
| Inner Portion of Bulk After Removal of Black Surface Layer | 120 | 4510 | 110 | 1420 | 0.037 |

ppm: by weight.

One of the sintered magnets prepared in this EXAMPLE was selected to take a photograph of its metal structure in a cross section by a transmission electron microscope [FE-TEM (HF-2100), available from Hitachi, Ltd.] under the conditions of acceleration voltage of 200 kV, filament current of 50 μA, and resolution of 1.9 Å.

Figure 3A:
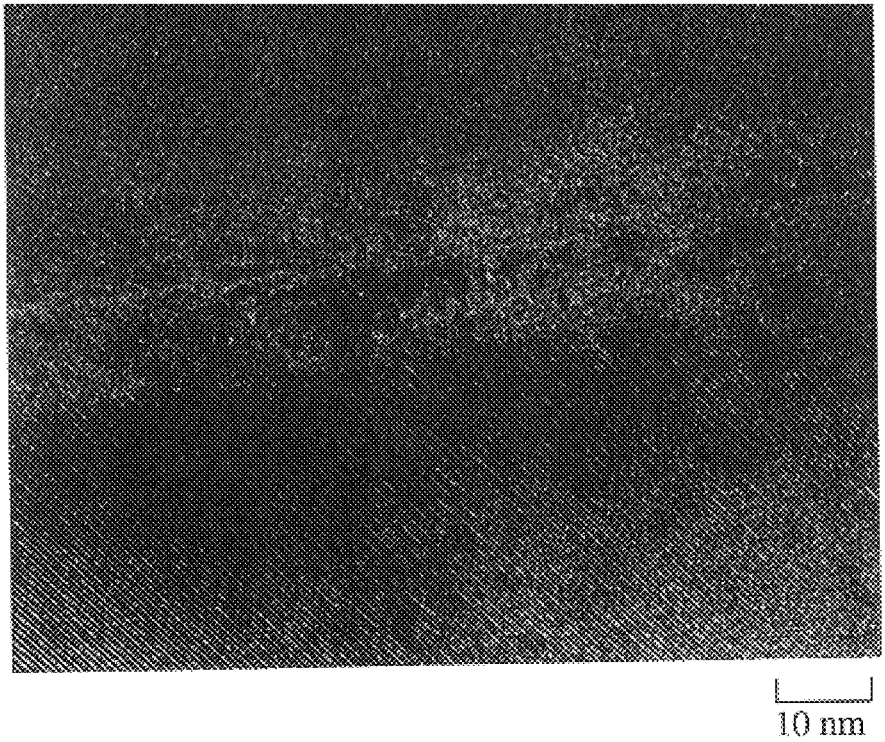
FIG. 3 (a) is a transmission electron microscopic photograph showing a region containing main-phase crystal grain particles having surface layer portions in the metal structure of the R—T—B rare earth sintered magnet of EXAMPLE 1.
Figure 3B:
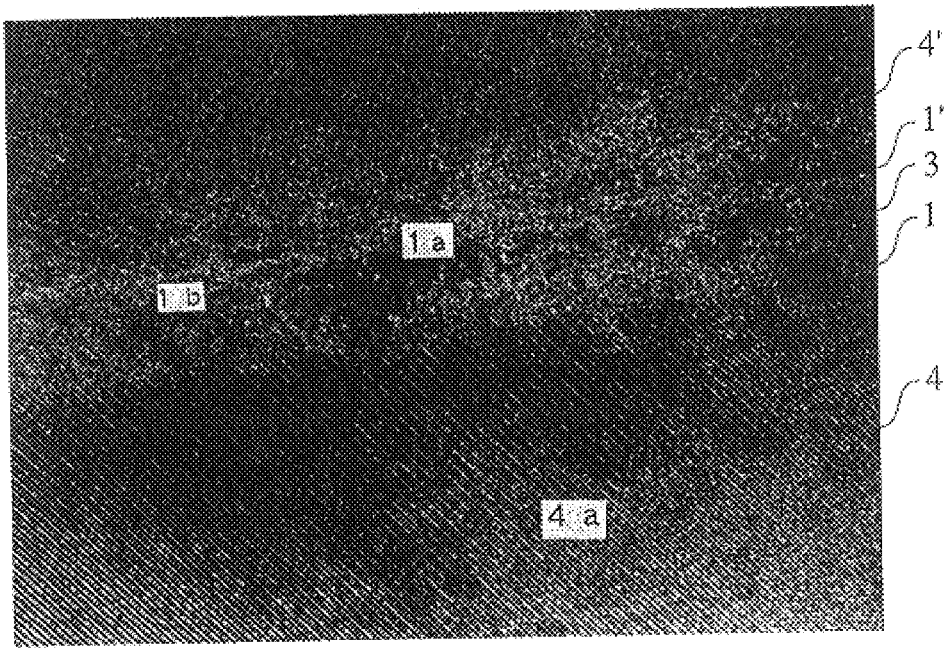
Figure 4:
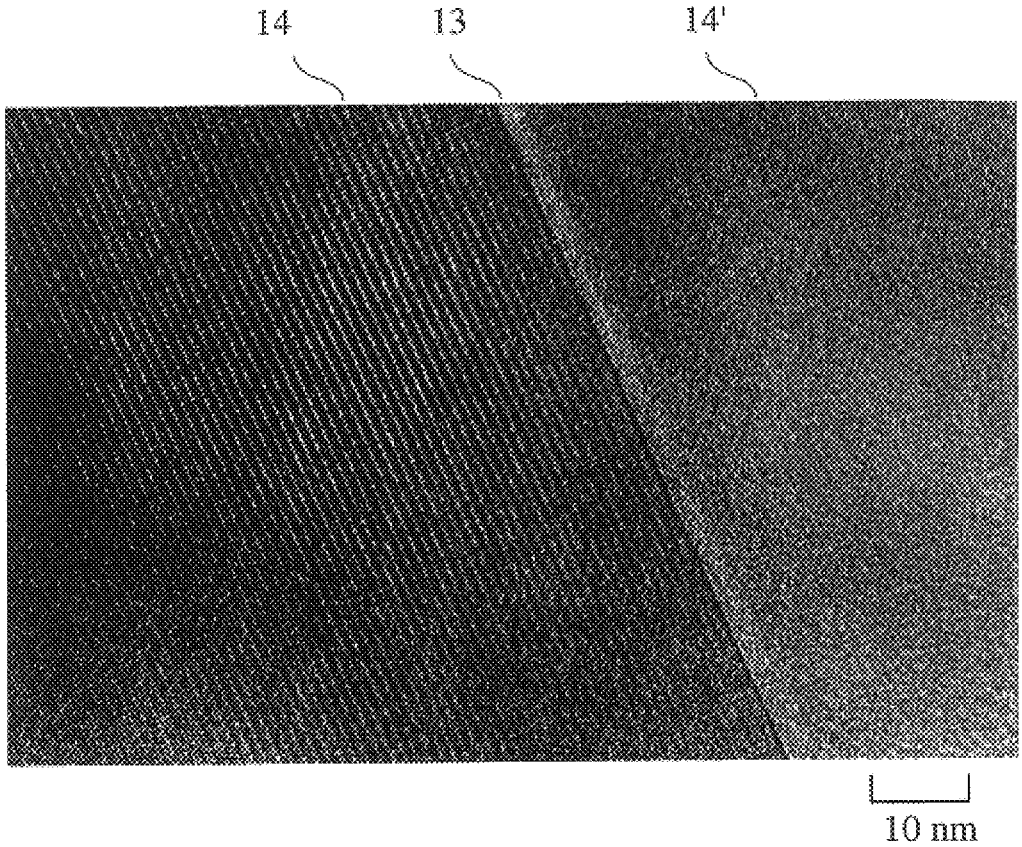
FIG. 4 is a transmission electron microscopic photograph showing a region containing main-phase crystal grain particles having no surface layer portions in the metal structure of the R—T—B rare earth sintered magnet.
Figure 5:
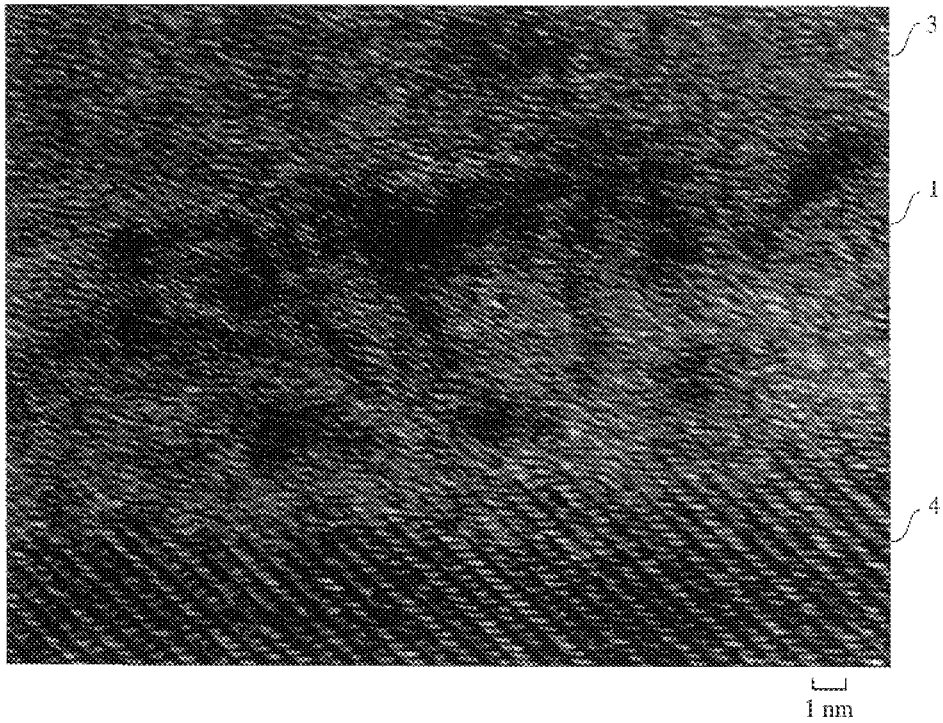
FIG. 5 is an enlarged transmission electron microscopic photograph showing a main-phase surface layer portion la of FIG. 3(*a*)

FIG. 3(*a*) is a TEM photograph showing a region of the metal structure of the R—T—B rare earth sintered magnet, in which there are main-phase crystal grain particles having surface layer portions, and FIG. 5 is an enlarged photograph of a portion 1a in FIG. 3(*a*). FIG. 3(*b*) is the TEM photograph of FIG. 3(*a*) to which reference numerals are added. Also, FIG. 4 is a TEM photograph showing a region of the metal structure of the same R—T—B rare earth sintered magnet, in which there are main-phase crystal grain particles having no surface layer portions.

In the metal structure of the sintered magnet produced from the R/D powder, a microstructure containing main-phase crystal grain particles having surface layer portions as shown in FIGS. 3(*a*) and 5 coexists with a microstructure containing main-phase crystal grain particles having no surface layer portions as shown in FIG. 4. The feature of the R—T—B rare earth sintered magnet formed from the R/D powder according to the present invention is that a percentage of the microstructure containing main-phase crystal grain particles having surface layer portions (shown in FIGS. 3(*a*) and 5) is extremely smaller than that of the R—T—B rare earth sintered magnet formed from the conventional R/D powder. Detailed explanation will be made referring to FIGS. 3–5 below.

As shown in FIG. 3(*b*), the metal structure shown in FIGS. 3–5 is characterized in that the $R_2T_{14}B$-type main-phase crystal grain is composed of a core portion 4 and a surface layer portion 1 in contact with an R-rich phase 3, and that the lattice of the surface layer portion 1 is discontinuous to both of the lattice of the core portion 4 and the lattice of the R-rich phase 3. The surface layer portion 1' is also discontinuous in lattice to both of the core portion 4' and the R-rich phase 3. From the fact that the lattices of the main-phase surface layer portions 1, 1' are discontinuous those of the main-phase core portions 4, 4', it is judged that the main-phase core portions 4, 4' and the main-phase surface layer portions 1, 1' are different crystal grains. The main-phase surface layer portions 1, 1' existed along the R-rich phase 3, and their thickness expressed by an average distance between the core portion 4 and the R-rich phase 3 was about 10 nm. Incidentally, the main-phase surface layer portions 1, 1', the main-phase core portions 4, 4', and the R-rich phase 3 were identified by an EDX analysis apparatus (VANTAGE, available from NORAN).

Figure 6:
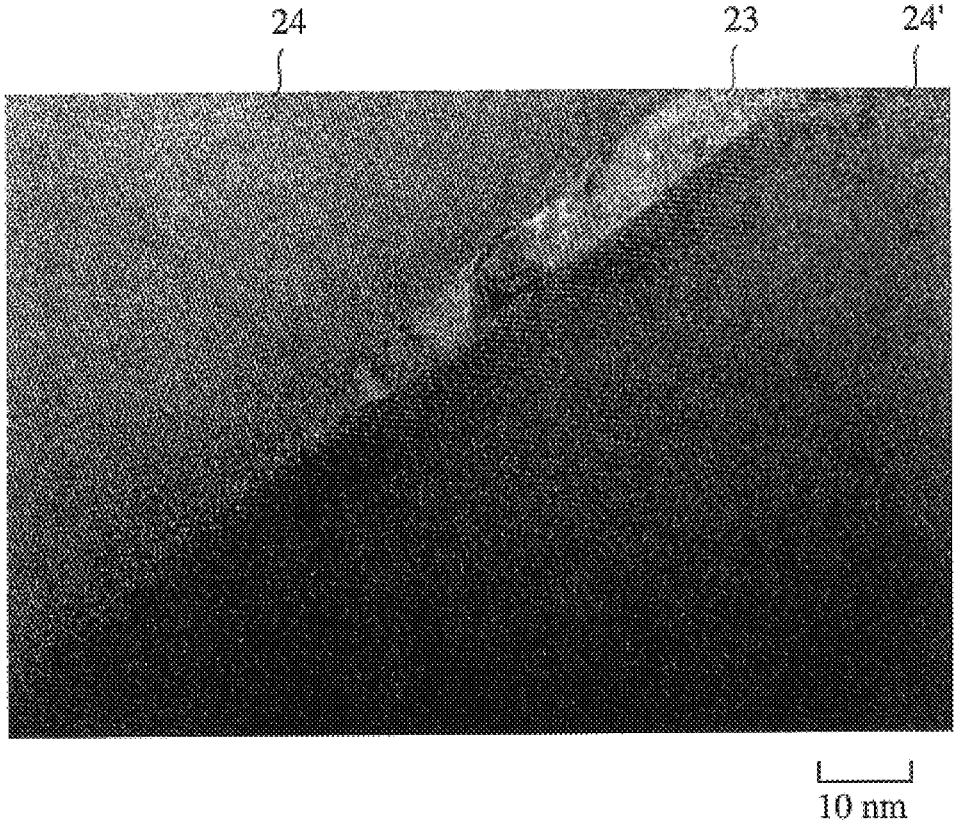
FIG. 6 is a transmission electron microscopic photograph showing the metal structure of the R—T—B rare earth sintered magnet formed from an alloy produced through melting in COMPARATIVE EXAMPLE 4.

The microstructure shown in FIGS. 4 and 6 was also identified in the same manner as above. Though main-phase crystal grain particles 14, 14' and an R-rich phase 13 were observed in FIG. 4, surface layer portions having discontinuous lattices were not observed in the main-phase crystal grain particles 14, 14'.

The observation of electron microscopic photographs (30 different fields) of a metal structure taken under the same conditions as in FIGS. 3–5 revealed that the number of main-phase crystal grain particles having surface layer portions constituted by discontinuous lattices as shown in FIG. 3 was extremely as small as 8% of the total number of the main-phase crystal grain particles. Incidentally, in the calculation of the number of the main-phase crystal grain particles having surface layer portions, a main-phase crystal grain particle circled by a surface layer portion constituted by a discontinuous lattice was conveniently counted as one main-phase crystal grain particle.

Figure 7A:
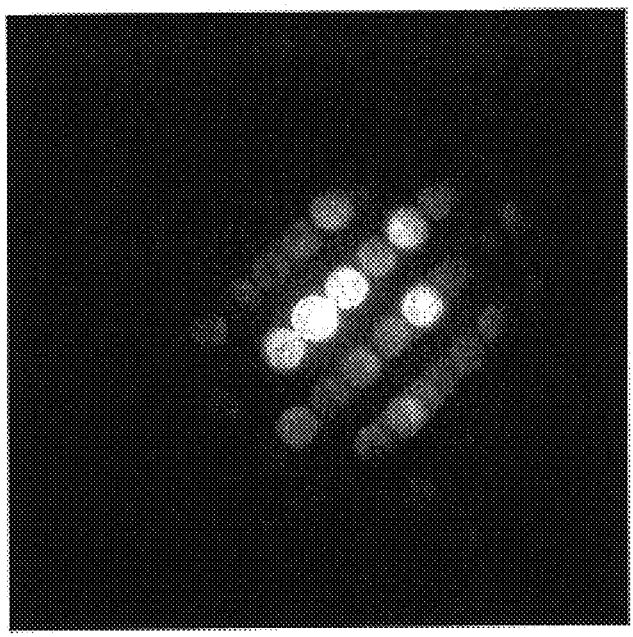
FIG. 7(*a*) is a transmission electron microscopic photograph showing an electron diffraction image of the main-phase core portion 4*a*of FIG. 3(*b*)
Figure 7B:
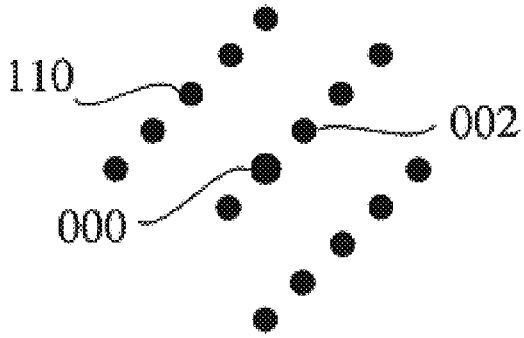

Electron diffraction images of main-phase surface layer portions 1*a*, 1*b* and a main-phase core portion 4*a* as shown in FIG. 3(*b*) were taken by a transmission electron microscope. Their photographed diffraction mottles are shown in FIGS. 7(*a*)–9(*a*). Also, FIGS. 7(*b*), 8(*b*) and 9(*b*) are respectively views of the diffraction mottles of FIGS. 7(*a*), 8(*a*) and 9(*a*), to which indices are added.

Figure 8A:
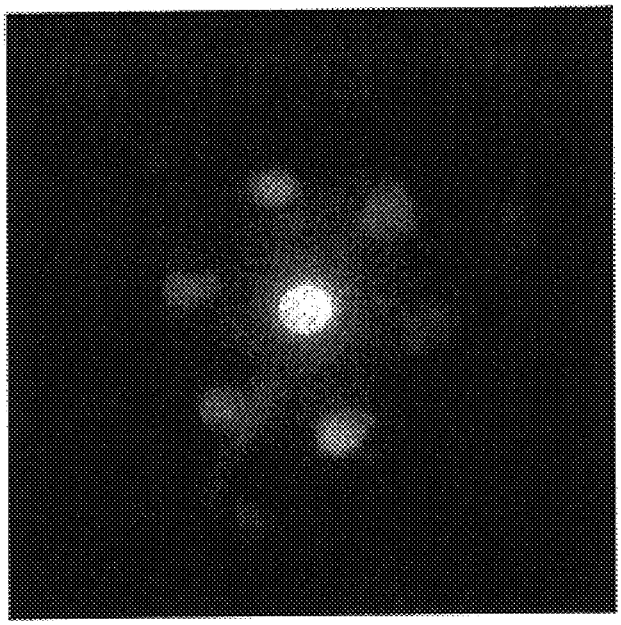
FIG. 8(*a*) is a transmission electron microscopic photograph showing an electron diffraction image of the main-phase surface layer portion la of FIG. 3(*b*)
Figure 8B:
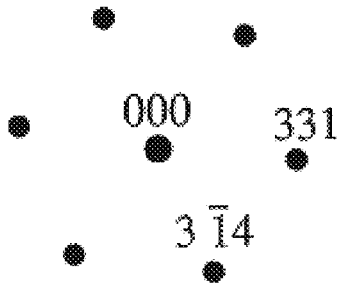

It was found in FIG. 7 that the direction of incident electron beam was [2-4 0], and that the c-axis direction of the main-phase core portion 4 was 90° relative to the direction of incident electron beam [2-4 0]. It was also found in FIG. 8 that the direction of incident electron beam was [13-9-12], and that the c-axis direction of the main-phase surface layer portion 1*a* was 52.8° relative to the direction of incident electron beam [13 -9 -12]. It was thus found that there is a difference of 47.2° (90–52.8) to 142.8° (90+52.8) in angle between the c-axis direction of the main-phase core portion 4 and that of the main-phase surface layer portion 1*a*.

Figure 9A:
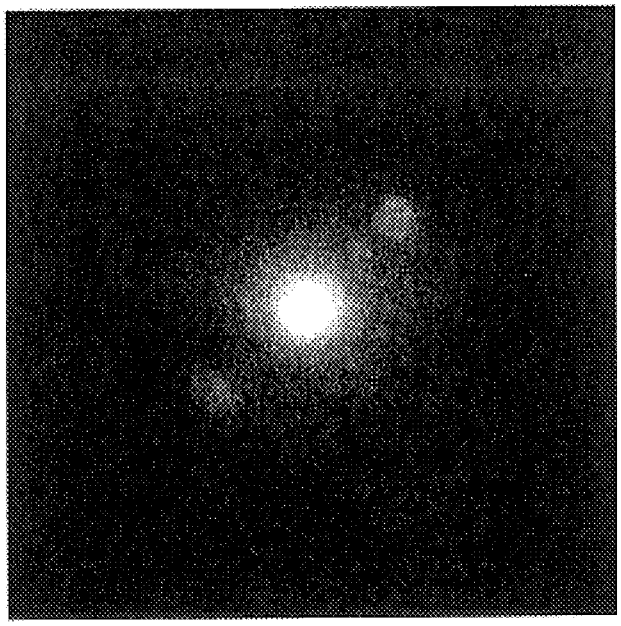
FIG. 9(*a*) is a transmission electron microscopic photograph showing an electron diffraction image of the main-phase surface layer portion 1*b* of FIG. 3(*b*)
Figure 9B:
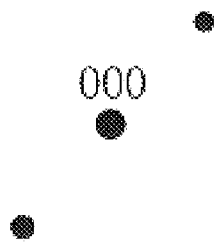

It was found from the diffraction mottle shown in FIG. 9 that the c-axis direction of the main-phase surface layer portion 1*b* was substantially the same as that of the main-phase surface layer portion 1*a*, and that the c-axis direction of the main-phase surface layer portion 1*b* was deviated by 47.20 to 142.8° from that of the main-phase core portion 4.

The observation results of cross section photographs and the corresponding electron diffraction patterns revealed that difference in a c-axis direction was as small as less than 5° between the main-phase core portions themselves, and that difference in a c-axis direction was 5° or more between any main-phase surface layer portion 1 and any main-phase core portion 4.

Figure 2:
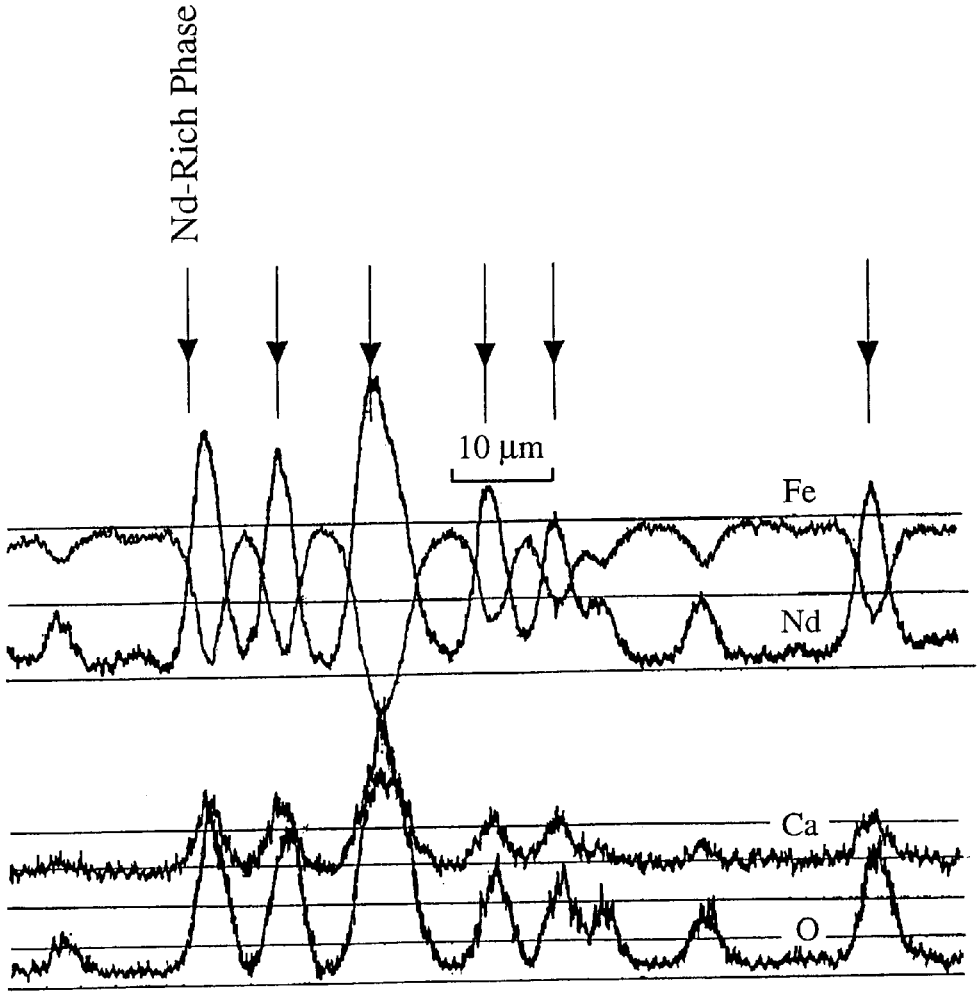
FIG. 2 is a view showing the EPMA results of the R—T—B rare earth sintered magnet of EXAMPLE 1.

FIG. 2 shows EPMA results of Nd, Fe, Ca and O atoms on a c-face surface of a sample prepared from the R—T—B rare earth sintered magnet formed from the R/D powder according to EXAMPLE 1. It was found from FIG. 2 that Ca existed at substantially the same positions as the Nd-rich phase.

The present invention provides an R—T—B rare earth sintered magnet having a drastically reduced Ca content as compared with the conventional R—T—B rare earth sintered magnet, due to effects of reducing the amount of Ca, not only by the Ca-removal heat treatment in vacuum but also by sintering in vacuum. It is considered that the Ca-removal reaction proceeds predominantly on surfaces of crystal grain boundaries (R-rich phase) having a large diffusion speed. Though details are not clarified, the R-rich phase is purified by Ca removal, leading to decrease in the main-phase surface layer portions having disturbed lattices. Because the fine crystals of the main-phase surface layer portions are oriented in random directions, the orientation of crystal grain particles in the entire sintered magnet is improved as the percentage of existence of the main-phase surface layer portions decreases, resulting in increase in a squareness ratio.

EXAMPLE 2

R/D powder obtained in the same manner as in EXAMPLE 1 was charged into a jet mill lined with a nitrogen gas atmosphere having an oxygen concentration of 0.001 volume %, for fine pulverization under pressure of 7.5 kg/cm$^2$ to an average particle size of 4.2 $\mu$m. The resultant fine powder was directly recovered in a mineral oil ("Idemitsu Super-Sol PA-30," ignition point: 81° C., fractional distillation point at 1 atm: 204–282° C. kinetic viscosity at room temperature: 2.0 cst, available from Idemitsu Kosan CO., LTD.) disposed at an outlet of the jet mill to form slurry.

The resultant fine powder slurry was subjected to a compression molding under the conditions of a magnetic field intensity of 10 kOe and compression pressure of 0.8 ton/cm$^2$. The resultant green body was charged into a vacuum furnace, in which it was subjected to oil removal at 200° C. in vacuum of about $5\times10^{-2}$ Torr for 2 hours. After heating from 200° C. to 1070° C. at an average temperature elevation speed of 1.5° C./minute in vacuum of about 5×1 Torr, sintering was carried out at 1070° C. for 3 hours. Thereafter, the same procedure as in EXAMPLE 1 was repeated to prepare a sintered magnet.

Analysis of the sintered magnet indicated that the main components were the same as in EXAMPLE 1, and that the amounts by weight of inevitable impurities were 30 ppm of Ca, 4440 ppm of O, and 0.06% of C. the magnetic properties and microstructure of this sintered magnet were evaluated in the same manner as in EXAMPLE 1. The results are shown in Table 2. The analysis of the microstructure indicated that difference in a c-axis direction was as small as less than 5° between the main-phase core portions themselves, and that difference in a c-axis direction was 5° or more between any main-phase surface layer portion and any main-phase core portion.

EXAMPLE 3

R/D powder was prepared in the same manner as in EXAMPLE 1 except for changing the Ca-removal heat treatment conditions to 1000° C.×3 hours. This R/D powder was formed into a sintered magnet for evaluation in the same manner as in EXAMPLE 1. The results are shown in Table 2. The C content of the sintered magnet was 0.07 weight %. The analysis of the microstructure indicated that difference in a c-axis direction was as small as less than 5° between the main-phase core portions themselves, and that difference in a c-axis direction was 5° or more between any main-phase surface layer portion and any main-phase core portion.

EXAMPLE 4

A sintered magnet was prepared and evaluated in the same manner as in EXAMPLE 2 except for using the R/D powder of EXAMPLE 3. The results are shown in Table 2. The C content of the sintered magnet was 0.06 weight %. The analysis of the microstructure indicated that difference in a c-axis direction was as small as less than 5° between the main-phase core portions themselves, and that difference in a c-axis direction was 5° or more between any main-phase surface layer portion and any main-phase core portion.

EXAMPLE 5

R/D powder was prepared in the same manner as in EXAMPLE 1 except for changing the Ca-removal heat treatment conditions to 900° C.×6 hours. This R/D powder was formed into a sintered magnet for evaluation in the same manner as in EXAMPLE 1. The results are shown in Table 2. The C content of the sintered magnet was 0.07 weight %. The analysis of the microstructure indicated that difference in a c-axis direction was as small as less than 5° between the main-phase core portions themselves, and that difference in a c-axis direction was 5° or more between any main-phase surface layer portion and any main-phase core portion.

EXAMPLE 6

A sintered magnet was prepared and evaluated in the same manner as in EXAMPLE 1 except for coarsely pulverizing an R/D powder bulk after the Ca-removal heat treatment, without removing a black surface layer thereof. The results are shown in Table 2. The C content of the sintered magnet was 0.09 weight %. The analysis of the microstructure indicated that difference in a c-axis direction was as small as less than 5° between the main-phase core portions themselves, and that difference in a c-axis direction was 5° or more between any main-phase surface layer portion and any main-phase core portion.

COMPARATIVE EXAMPLE 1

A sintered magnet was prepared and evaluated in the same manner as in EXAMPLE 1 except for changing the Ca-removal heat treatment conditions to 700° C.×6 hours. The results are shown in Table 2.

COMPARATIVE EXAMPLE 2

A sintered magnet was prepared and evaluated in the same manner as in EXAMPLE 1 except for sintering in an Ar gas atmosphere under atmospheric pressure. The results are shown in Table 2.

COMPARATIVE EXAMPLE 3

A sintered magnet was prepared and evaluated in the same manner as in EXAMPLE 1 except for carrying out no Ca-removal heat treatment. The results are shown in Table 2.

COMPARATIVE EXAMPLE 4

A sintered magnet was prepared and evaluated in the same manner as in EXAMPLE 1 except for using an alloy having the same composition as that of the R/D powder of EXAMPLE 1 and produced through melting. The results are shown in Table 2. The cross section structure of the sintered magnet of this COMPARATIVE EXAMPLE is shown in FIG. 6. It was found from FIG. 6 that the microstructure of the sintered magnet of this COMPARATIVE EXAMPLE was composed of main-phase crystal grain particles 24, 24' and an R-rich phase 23 without main-phase surface layer portions having lattices discontinuous to those of the main-phase crystal grain particles 24, 24'.

TABLE 2

| No. | Heating Conditions for Ca-Removal | Removal of Black Surface Layer | Ca Content in R/D Alloy (ppm) Before Ca Removal | Ca Content in R/D Alloy (ppm) After Ca Removal | Sintering Atmosphere |
|---|---|---|---|---|---|
| Ex. 1 | 1100° C. × 6 hours | Yes | 500 | 120 | Vacuum |
| Ex. 2 | 1100° C. × 6 hours | Yes | 500 | 120 | Vacuum |
| Ex. 3 | 1000° C. × 3 hours | Yes | 500 | 210 | Vacuum |
| Ex. 4 | 1000° C. × 3 hours | Yes | 500 | 210 | Vacuum |
| Ex. 5 | 900° C. × 6 hours | Yes | 500 | 410 | Vacuum |
| Ex. 6 | 1100° C. × 6 hours | No | 500 | 180 | Vacuum |
| Com. Ex. 1 | 700° C. × 6 hours | Yes | 500 | 500 | Vacuum |
| Com. Ex. 2 | 1100° C. × 6 hours | Yes | 500 | 120 | Ar |
| Com. Ex. 3 | — | No | 500 | — | Vacuum |
| Com. Ex. 4* | — | — | — | — | Vacuum |

Note *COMPARATIVE EXAMPLE 4 used an alloy (Ca content: less than 10 ppm) produced through melting.

| No. | Impurities: Sintered Magnet Ca (ppm) | Impurities: Sintered Magnet O (ppm) | Main-phase surface layer portion* (%) | Magnetic Properties: Hk/iHc (%) | Magnetic Properties: $(BH)_{max}$ (MGOe) | Magnetic Properties: IHc (kOe) | Magnetic Properties: Thermal Demagnetization Ratio (%) |
|---|---|---|---|---|---|---|---|
| Ex. 1 | 30 | 5620 | 8 | 96.5 | 39.1 | 14.5 | 0.5 |
| Ex. 2 | 30 | 4440 | 7 | 96.6 | 39.4 | 15.4 | 0.4 |
| Ex. 3 | 50 | 5500 | 20 | 96.3 | 39.0 | 15.0 | 0.6 |
| Ex. 4 | 50 | 4020 | 19 | 96.3 | 39.5 | 15.2 | 0.5 |
| Ex. 5 | 70 | 5400 | 27 | 95.4 | 39.0 | 14.9 | 0.8 |
| Ex. 6 | 40 | 5690 | 13 | 96.0 | 38.8 | 14.3 | 0.7 |
| Com. Ex. 1 | 130 | 5550 | 58 | 89.8 | 38.6 | 14.1 | 2.0 |
| Com. Ex. 2 | 120 | 5650 | 53 | 90.2 | 38.6 | 14.2 | 1.9 |
| Com. Ex. 3 | 130 | 5020 | 58 | 89.8 | 38.6 | 14.6 | 2.0 |
| Com. Ex. 4* | 0 | 4500 | 0 | 97.0 | 39.5 | 15.0 | 0.4 |

Note *A ratio of the number of main-phase crystal grain particles having surface layer portions.
ppm: by weight.

FIG. 1 shows plots of the data of Table 2 concerning the Ca content and the squareness ratio in EXAMPLES 1–6 and COMPARATIVE EXAMPLES 1–4.

The comparison of EXAMPLES 1–6 with COMPARATIVE EXAMPLE 1 in Table 2 revealed:

(1) A Ca-removal heat treatment at 900–1100° C. reduces the Ca content of the R/D powder, though the Ca-removal heat treatment at 700° C. fails to provide sufficient effects of removing Ca.

(2) Sintering in vacuum in EXAMPLES 1–6 is effective to reduce the Ca content to 90–340 ppm.

(3) A ratio of the number of main-phase crystal grain particles having surface layer portions was as low as 7–27% in the sintered magnets prepared in EXAMPLES 1–6, though it was as high as 58% in COMPARATIVE EXAMPLE 1.

(4) The sintered magnets prepared in EXAMPLES 1–6 had squareness ratios (Hk/iHc) of 95.4% or more, $(BH)_{max}$ of 38.8 MGOe or more, and a thermal demagnetization ratio of 0.8% or less, though the sintered magnet of COMPARATIVE EXAMPLE 1 had as low a squareness ratio (Hk/iHc) as less than 90%, as low $(BH)_{max}$ as 38.6 MGOe, and as high a thermal demagnetization ratio as 2.0%.

Also, the comparison of EXAMPLE 1in which both of a Ca-removal heat treatment and sintering in vacuum were carried out and COMPARATIVE EXAMPLE 2 in which a Ca-removal heat treatment and sintering in Ar were carried out revealed that even though the Ca content of the R/D powder is reduced by the Ca-removal heat treatment, it is difficult to reduce the Ca content of the sintered magnet to 100 ppm or less when sintering is carried out in Ar. Accordingly, in the sintered magnet of COMPARATIVE EXAMPLE 2, the number of main-phase crystal grain particles having surface layer portions is more than 50%, resulting in poor squareness ratio and thermal demagnetization ratio.

Further, the comparison of EXAMPLE 1with EXAMPLE 6 revealed that by removing a black surface layer from the R/D powder bulk after the Ca-removal heat treatment, the Ca content of the resultant sintered magnet is reduced, resulting in decrease in a ratio of the number of main-phase crystal grain particles having surface layer portions (existence ratio of main-phase surface layer portions), which leads to improvement in squareness ratio and thermal demagnetization ratio.

Thus, the present invention can provide the sintered magnet with substantially the same level of squareness ratio and thermal demagnetization ratio as in a sintered magnet formed from an alloy produced through melting in COMPARATIVE EXAMPLE 4. In the sintered magnet of COMPARATIVE EXAMPLE 4, no main-phase surface layer portions were observed.

Though the above EXAMPLES show sintered magnets coated with an epoxy resin, other coating layers such as Ni plating having good heat resistance may be formed to make the sintered magnets useful for applications requiring high heat resistance such as voice coil motors, spindle motors, etc.

The present invention is not restricted to R—T—B rare earth sintered magnets formed only from the R/D powder, but includes R—T—B rare earth sintered magnets obtained from a mixture of the R/D powder and alloy powder produced through melting at desired ratios. In this case, to reduce the cost of starting materials, a weight ratio of the R/D powder to the alloy powder produced through melting is preferably 10/90–100/0, more preferably 30/70–100/0, particularly 50/50–100/0.

Though metallic Ca was used as a reducing agent in the above EXAMPLES, a hydride of Ca, metallic Mg, a hydride of Mg or mixtures thereof may also be used. In such a Case, the content of Mg or (CA+Mg) can be reduced to 0.01 weight % or less, with substantially the same effects as in the above EXAMPLES.

According to the method of the present invention, the Ca content of the R/D powder can be reduced by a Ca-removal heat treatment, as compared with the conventional reduction and diffusion method. Ca removal is also carried out in the process of turning the green body to the sintered magnet by sintering in vacuum, thereby providing the sintered magnet with reduced Ca content, leading to improvement in a squareness ratio. Thus, the R—T—B rare earth sintered magnet of the present invention has a squareness ratio of 95.0% or more at room temperature. The method of the present invention can produce an R—T—B rare earth sintered magnet at extremely lower cost than the melting method.

What is claimed is:

1. An R—T—B rare earth sintered magnet formed from R—T—B alloy powder produced by a reduction and diffusion method, which R—T—B rare earth sintered magnet has an improved squareness ratio and contains as a main phase an $R_2T_{14}B$-type intermetallic compound, wherein R is at least one rare earth element including Y, at least one of Nd, Dy and Pr being indispensable, and T is Fe or Fe and Co, the amount of Ca contained as an inevitable impurity being 0.01 weight % or less, and c-axis directions of core portions of the main-phase crystal grain particles being deviated by 5° or more from those of surface layer portions of the main phase crystal grain particles, wherein the number of said main phase crystal grain particles each having a surface layer portion is 50% or less of the total number of said main phase crystal grain particles.

2. The R—T—B rare earth sintered magnet according to claim 1 wherein said main components are composed of 27–34 weight % of R, and 0.5–2 weight % of B, the balance being substantially T, wherein the amounts of oxygen and carbon contained as inevitable impurities are 0.6 weight % or less and 0.1 weight % or less, respectively, and wherein said R—T—B rare earth sintered magnet has a squareness ratio of 95.0% or more at room temperature.

3. The R—T—B rare earth sintered magnet according to claim 1, wherein the number of said main-phase crystal grain particles having surface layer portions is 30% or less of the total number of said main-phase crystal grain particles.

4. The R—T—B rare earth sintered magnet according to claim 1, wherein said magnet further contains at least one element selected from the group consisting of Nb, Al, Ga and Cu.

5. The R—T—B rare earth sintered magnet according to claim 4, wherein said magnet contains 0.–2 weight % of Nb, 0.02–2 weight % of Al, 0.01–0.5 weight % of Ga, and 0.01–1 weight % of Cu.

6. The R—T—B rare earth sintered magnet according to claim 1, wherein said main phase includes a main-phase core portion having a surface layer portion and a main-phase core portion having no surface layer portion.

7. The R—T—B rare earth sintered magnet according to claim 1, wherein said reduction and diffusion method comprises the steps of:

(a) a mixing oxide powder of at least one rare earth element R, wherein R is at least one rare earth element including Y, at least one of Nd, Dy and Pr being indispensable, T-containing powder, wherein T is Fe or Fe and Co, B-containing powder, and at least one reducing agent selected from the group consisting of Ca, Mg and hydrides thereof, (b) heating the resultant mixture at 900–1350° C. in a non-oxidizing atmosphere, (c) removing reaction by-products from the resultant reaction product by washing, and (d) carrying out a heat treatment for Ca removal by heating the resultant R—T—B rare earth alloy powder at 900–1200° C. in vacuum at 1 Torr or less, followed by pulverization of the resultant alloy powder bulk, molding, sintering in vacuum, heat treatment, and surface treatment.

8. The R—T—B rare earth sintered magnet according to claim 7, wherein said heating is carried out at 1000–1200° C.

9. The R—T—B rare earth sintered magnet according to claim 7, wherein said heat treatment for Ca removal is carried out at 900–1100° C. in vacuum between 1 Torr and $9\times10^{-6}$ Torr.

10. The R—T—B rare earth sintered magnet according to claim 7, wherein said alloy powder bulk obtained by the heat treatment for Ca removal is pulverized after removal of its surface layer.

11. The R—T—B rare earth sintered magnet according to claim 7, wherein said sintering in vacuum is carried out at 1030–1150° C. for 0.5–8 hours.

12. The R—T—B rare earth sintered magnet according to claim 7, wherein the degree of vacuum in the process of temperature elevation for said sintering is in the range of $9\times10^{-6}$ Torr to $1\times10^{-2}$ Torr.

13. The R—T—B rare earth sintered magnet according to claim 7, wherein the temperature elevation speed for said sintering is 0.1–500° C./minute.

14. The R—T—B rare earth sintered magnet according to claim 7, wherein said heat treatment is carried out at a temperature of 800–1000° C. for 0.2–5 hours in an inert gas atmosphere, followed by cooling to a temperature between room temperature and 600° C. at a cooling speed of 0.3–50° C./minute, and further said heat treatment is carried out at 500–650° C. for 0.2–3 hours, followed by cooling at a cooling speed of 0.3–400° C./minute.

15. The R—T—B rare earth sintered magnet according to claim 1, wherein the content of said Nb is 0.1–2 weight %.

16. The R—T—B rare earth sintered magnet according to claim 1, wherein a ratio of the number of said main phase crystal grain particles having surface layer portions is more than 7.

17. The R—T—B rare earth sintered magnet according to claim 1, wherein a residual amount of said Ca in said R—T—B rare earth sintered magnet is 0.001%<Ca<0.01% by weight.

* * * * *